US010441974B2

(12) United States Patent
Song et al.

(10) Patent No.: US 10,441,974 B2
(45) Date of Patent: Oct. 15, 2019

(54) ULTRASONIC TRANSDUCER AND ULTRASONIC PROBE INCLUDING THE SAME

(71) Applicant: SAMSUNG MEDISON CO., LTD., Hongcheon-gun (KR)

(72) Inventors: In-seong Song, Hongcheon-gun (KR); Dong-hyun Kim, Hongcheon-gun (KR); Gil-ju Jin, Hongcheon-gun (KR)

(73) Assignee: SAMSUNG MEDISON CO., LTD., Hongcheon-gun (KR)

( * ) Notice: Subject to any disclaimer, the term of this patent is extended or adjusted under 35 U.S.C. 154(b) by 416 days.

(21) Appl. No.: 15/374,133

(22) Filed: Dec. 9, 2016

(65) Prior Publication Data

US 2017/0216887 A1 Aug. 3, 2017

(30) Foreign Application Priority Data

Jan. 28, 2016 (KR) ..... 10-2016-0010985

(51) Int. Cl.
*B06B 1/06* (2006.01)

(52) U.S. Cl.
CPC ..... *B06B 1/0622* (2013.01); *B06B 1/0644* (2013.01); *B06B 1/067* (2013.01); *B06B 1/0648* (2013.01); *B06B 1/0662* (2013.01); *B06B 1/0674* (2013.01)

(58) Field of Classification Search
CPC ... A61B 8/4483; A61B 8/4281; A61B 8/4444; A61B 8/4494; B06B 1/0607; B06B 1/0622; B06B 1/0644; B06B 1/0662; B06B 1/067; B06B 1/0674; B06B 1/0648
See application file for complete search history.

(56) References Cited

U.S. PATENT DOCUMENTS

| | | | | |
|---|---|---|---|---|
| 5,486,734 | A | 1/1996 | Seyed-Bolorforosh | |
| 2008/0097216 | A1 | 4/2008 | Crunkilton et al. | |
| 2009/0072668 | A1* | 3/2009 | Gelly | G10K 11/02 310/334 |
| 2012/0123274 | A1 | 5/2012 | Ikeda et al. | |
| 2014/0180103 | A1 | 6/2014 | Sinelnikov | |
| 2014/0221841 | A1 | 8/2014 | Okuda | |
| 2014/0257109 | A1* | 9/2014 | Nishikubo | H01L 41/37 600/459 |
| 2014/0375171 | A1* | 12/2014 | Tai | H01L 41/0825 310/341 |
| 2015/0115773 | A1* | 4/2015 | Li | B06B 1/0677 310/335 |

(Continued)

FOREIGN PATENT DOCUMENTS

EP 3040130 A1 7/2016

OTHER PUBLICATIONS

Communication dated Jun. 16, 2017, issued by the European Patent Office in counterpart European Application No. 16202978.9.

*Primary Examiner* — J. San Martin
(74) *Attorney, Agent, or Firm* — Sughrue Mion, PLLC

(57) ABSTRACT

An ultrasonic transducer and an ultrasonic probe including the same are provided. The ultrasonic transducer includes a piezoelectric layer configured to convert an electric signal and an ultrasound into each other, and a dematching layer having a uniform thickness, the dematching layer being arranged on a partial region of the piezoelectric layer and configured to reflect the second ultrasound wave that is incident on the dematching layer.

19 Claims, 8 Drawing Sheets

(56) References Cited

U.S. PATENT DOCUMENTS

| | | | | |
|---|---|---|---|---|
| 2015/0182999 | A1* | 7/2015 | Zhao | B06B 1/0622 310/334 |
| 2015/0183000 | A1* | 7/2015 | Tai | G01S 7/52017 367/7 |
| 2015/0270474 | A1 | 9/2015 | Osawa | |
| 2017/0065253 | A1* | 3/2017 | Li | H01L 41/312 |

* cited by examiner

ULTRASONIC TRANSDUCER AND ULTRASONIC PROBE INCLUDING THE SAME

CROSS-REFERENCE TO RELATED APPLICATION

This application claims the benefit of Korean Patent Application No. 10-2016-0010985, filed on Jan. 28, 2016, in the Korean Intellectual Property Office, the disclosure of which is incorporated herein in its entirety by reference.

BACKGROUND

1. Field

One or more embodiments relate to an ultrasonic transducer capable of increasing resolution of an image and an ultrasonic probe including the ultrasonic transducer.

2. Description of the Related Art

In general, ultrasound diagnosis apparatuses transmit ultrasound waves to an object such as a human being or an animal and detect an echo signal reflected by the object to display a cross-sectional image of organs on a monitor and provide information necessary to diagnose the object. In this regard, ultrasound diagnosis apparatuses include an ultrasonic probe for transmitting the ultrasound wave into the object and receiving the echo signal reflected from the object.

In addition, an ultrasonic probe includes a piezoelectric layer disposed therein to convert ultrasound signals into electric signals and vice versa, and the piezoelectric layer generally includes an assembly of a plurality of piezoelectric members. Therefore, an ultrasound diagnosis apparatus including such components as described above irradiates ultrasound waves to a target object and converts an echo signal of the ultrasound wave into an electric signal to generate an ultrasound image.

An ultrasound diagnosis apparatus using such an ultrasonic probe is widely used for medical usage, for example, detection of impurities in a living body, measuring wounds, observing a tumor, and observing an embryo.

Research into the ultrasonic probe that is capable of increasing resolution of an image has been conducted.

SUMMARY

One or more embodiments include a transducer from among transducers that is capable of magnifying intensity of ultrasound waves emitted from a certain region, and an ultrasonic probe that includes the transducer.

Additional aspects will be set forth in part in the description which follows and, in part, will be apparent from the description, or may be learned by practice of the presented embodiments.

According to one or more embodiments, an ultrasonic transducer includes a piezoelectric layer configured to convert an electric signal and an ultrasound into each other, and a dematching layer having a uniform thickness, the dematching layer being arranged on a partial region of the piezoelectric layer and configured to reflect the second ultrasound wave that is incident on the dematching layer.

The piezoelectric layer may include a groove.

The dematching layer may be arranged in the groove.

The dematching layer may be symmetric about a central axis of the ultrasonic transducer.

The piezoelectric layer may include a first piezoelectric layer that has a first thickness and does not overlap the dematching layer, and a second piezoelectric layer that has a second thickness and overlaps the dematching layer.

The first and second thicknesses may be uniform.

The first thickness may be greater than the second thickness.

A sum of a thickness of the dematching layer and a thickness of the second piezoelectric layer may be equal to or less than a thickness of the first piezoelectric layer.

A ratio between the first thickness and the second thickness may be a multiple of ¼ of a wavelength of the ultrasound wave.

The first thickness may be a multiple of ½ of a wavelength of the ultrasound wave.

The first piezoelectric layer and the second piezoelectric layer may include a same material.

The first piezoelectric layer may contact the second piezoelectric layer.

The first piezoelectric layer may be spaced apart from the second piezoelectric layer.

The first piezoelectric layer may be spaced apart from the second piezoelectric layer by a distance that is less than a wavelength of the ultrasound wave.

The ultrasonic transducer may further include a third piezoelectric layer that has a third thickness and does not overlap the dematching layer.

The third thickness may be the same as the first thickness.

The ultrasonic transducer may further include an electrode that contacts the piezoelectric layer and the dematching layer.

The dematching layer may include a plurality of sub dematching layers that are spaced apart from each other.

The partial region of the piezoelectric layer may be arranged between the plurality of sub dematching layers.

According to one or more embodiments, an ultrasonic probe includes: the above-described ultrasonic transducer; and a matching layer that is disposed on the ultrasonic transducer and matches an acoustic impedance of the ultrasound wave and an acoustic impedance of an object.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1:
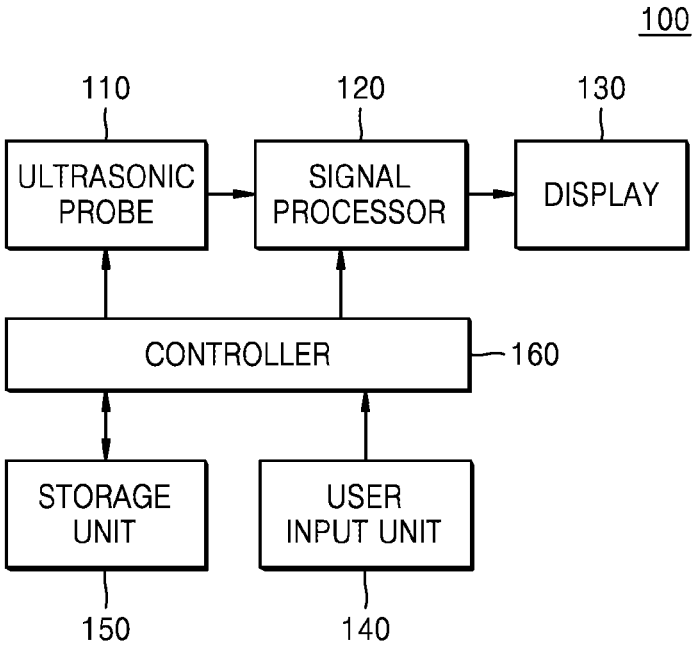
FIG. 1 is a block diagram of an ultrasonic diagnosis apparatus according to an embodiment.

Reference will now be made in detail to embodiments, examples of which are illustrated in the accompanying drawings, wherein like reference numerals refer to like elements throughout. Expressions such as "at least one of," when preceding a list of elements, modify the entire list of elements and do not modify the individual elements of the list.

Throughout the specification, an "object" may be a human, an animal, or a part of a human or animal. For example, the object may be an organ (e.g., the liver, heart, womb, brain, breast, or abdomen) or a blood vessel. Throughout the specification, a "user" may be, but is not limited to, a medical expert including a medical doctor, a nurse, a medical laboratory technologist, a medial image expert, or a technician who repairs a medical apparatus.

FIG. 1 is a block diagram of an ultrasound diagnosis apparatus 100 according to an embodiment. Referring to FIG. 1, the ultrasound diagnosis apparatus 100 includes an ultrasonic probe 110 for transmitting and receiving ultrasound waves, a signal processor 120 for processing a signal applied from the ultrasonic probe 110 to generate an image, a display 130 for displaying the image, a user input unit 140 for receiving an input of a user command, a storage unit 150 storing various pieces of information, and a controller 160 for controlling overall operations of the ultrasound diagnosis apparatus 100.

The ultrasonic probe 110 is an apparatus for transmitting an ultrasound wave to an object and receiving an echo signal of the ultrasound wave that is reflected by the object, and this will be described in detail later.

The signal processor 120 processes ultrasound data generated by the ultrasonic probe 110 to generate an ultrasound image. The ultrasound image may be at least one of a brightness mode (B mode) image representing the magnitude of an ultrasound echo signal reflected by an object as brightness, a Doppler mode (D mode) image representing an image of a moving object as a spectrum by using a Doppler effect, a motion mode (M mode) image representing movement of an object at a constant location according to time, an elastic mode image representing a difference between reactions when compression is applied and not applied to an object as an image, and a color mode (C mode) image representing a velocity of a moving object as a color by using a Doppler effect. Since the ultrasound image is generated by using an ultrasound image generating method that is currently implemented, detailed descriptions thereof will be omitted. Accordingly, the ultrasound image may be a one-dimensional (1D) image, a two-dimensional (2D) image, a three-dimensional (3D) image, or a four-dimensional (4D) image.

The display 130 displays information processed by the ultrasound diagnosis apparatus 100. For example, the display 130 may display the ultrasound image generated by the signal processor 120, or may display a graphical user interface (GUI) for requesting a user input.

The display 130 may include at least one of a liquid crystal display, a thin film transistor-liquid crystal display, an organic light-emitting diode display, a flexible display, a 3D display, and an electrophoretic display, and in some embodiments, the ultrasound diagnosis apparatus 100 may include two or more displays 130.

The user input unit 140 is a unit to which a user inputs data for controlling the ultrasound diagnosis apparatus 100. The user input unit 140 may include a keypad, a mouse, a touch panel, a track bump, or the like. The user input unit 140 is not limited to the above examples and may further include various input units such as a jog wheel or a jog switch.

In addition, the touch panel may detect a proximity touch, that is, a case where a pointer approaches a screen within a predetermined distance, as well as a real touch, that is, a case where the pointer actually touches the screen. In the present specification, the pointer is a tool for touching or proximity touching a certain point of the touch panel, for example, a stylus pen or a body part such as a finger.

Also, the touch panel may be realized as a touch screen forming a layer structure with the display 130, and the touch screen may be of various types such as a capacitive overlay type, a resistive overlay type, an infrared beam type, a surface acoustic wave type, an integral strain gauge type, or a piezo electric type. The touch screen may serve as the user input unit 140, as well as the display 130, and thus, may be widely used.

Although not shown in FIG. 1, the touch panel may include various sensors in or around the touch panel in order to sense a touch input. An example of the sensors for the touch panel to sense the touch input may be a tactile sensor. The tactile sensor senses a contact of a certain material at an intensity that a human being may feel or greater. The tactile sensor may sense various pieces of information such as the roughness of a contact surface, the solidity of a contact material, and the temperature at a contact point.

Also, an example of the sensors for the touch panel to sense the touch input may be a proximity sensor. The proximity sensor is a sensor for detecting whether an object approaches a predetermined detection surface or whether the external object is present nearby by using a force of an electromagnetic field or an infrared ray without an actual physical touch. Examples of the proximity sensor include a transparent photoelectric sensor, a direct reflective photoelectric sensor, a mirror reflective photoelectric sensor, a high frequency oscillation photoelectric sensor, a capacitive photoelectric sensor, a magnetic photoelectric sensor, an infrared photoelectric sensor, etc.

The storage unit 150 stores various pieces of information processed by the ultrasound diagnosis apparatus 100. For example, the storage unit 150 may store medical data regarding diagnosis of an object, for example, images, and may store algorithms or programs executed in the ultrasound diagnosis apparatus 100.

The storage unit 150 may include at least one type of a storage medium selected from a flash memory type, a hard disk type, a multimedia card micro type, a card-type memory (for example, SD, XD memory, etc.), random access memory (RAM), static random access memory (SRAM), read-only memory (ROM), electrically erasable programmable read-only memory (EEPROM), programmable read-only memory (PROM), a magnetic memory, a magnetic disk, and an optical disk. Also, the ultrasound diagnosis apparatus 100 may use a web storage or cloud server performing a storage function of the storage unit 150 on the Internet.

The controller 160 controls overall operations of the ultrasound diagnosis apparatus 100. That is, the controller 160 may control operations of the ultrasonic probe 110, the signal processor 120, the display 130, and the like shown in FIG. 1. For example, the controller 160 may control the signal processor 120 to generate an image by using a user command that is input via the user input unit 140 or a program stored in the storage unit 150. Also, the controller 160 may control the display 130 to display the image generated by the signal processor 120.

Figure 2:
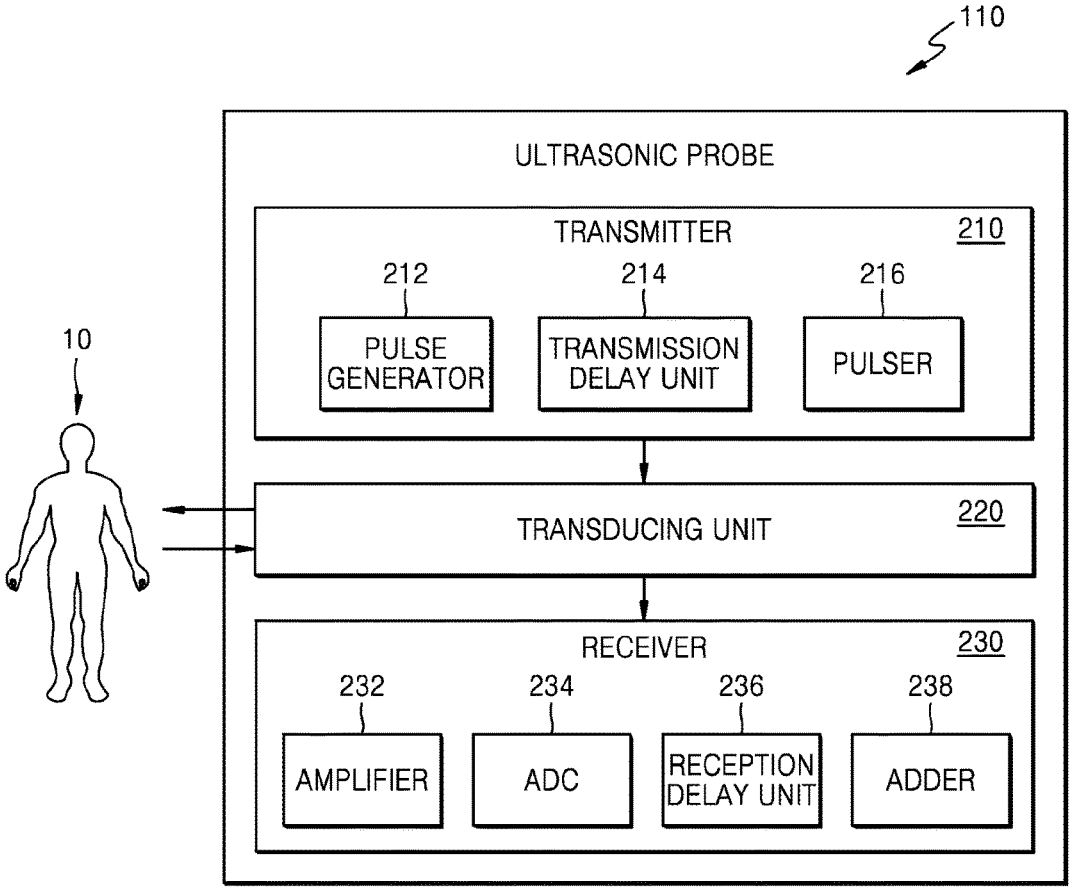
FIG. 2 is a block diagram of an ultrasonic probe illustrated in FIG. 1.

FIG. 2 is a block diagram of the ultrasonic probe 110 of FIG. 1. Referring to FIG. 2, the ultrasonic probe 110, which is a device for transmitting an ultrasound wave to an object 10 and receiving an echo signal reflected by the object 10 to generate ultrasound data, may include a transmitter 210, a transducing unit 220, and a receiver 230.

The transmitter 210 supplies a driving signal to the transducing unit 220. The transmitter 210 may include a pulse generator 212, a transmission delay unit 214, and a pulser 216.

The pulse generator 212 generates rate pulses for forming a transmission frequency according to a predetermined pulse repetition frequency (PRF). The transmission delay unit 214 applies a delay time for determining transmission directionality to the rate pulses generated by the pulse generator 212. The rate pulses to which the delay time is applied respectively correspond to a plurality of transducers 310 included in the transducing unit 220. The pulser 216 applies driving signals (or driving pulses) to a piezoelectric layer 312 at timings corresponding respectively to the rate pulses, to which the delay time is applied.

The transducing unit 220 transmits the ultrasound wave to the object 10 according to the driving signal supplied from the transmitter 210, and receives an echo signal of the ultrasound wave that is reflected by the object 10. The transducing unit 220 may include the plurality of transducers 310 that convert an electric signal to acoustic energy (or vice versa).

The receiver 230 processes a signal that is transmitted from the transducing unit 220 to generate ultrasound data. The receiver 230 may include an amplifier 232, an analog digital converter (ADC) 234, a reception delay unit 236, and an adder 238.

The amplifier 232 amplifies the signal transmitted from the transducing unit 220, and the ADC 234 performs analog-digital conversion of the amplified signal. The reception delay unit 236 applies a delay time for determining the reception directionality to the digitally converted signal. The adder 238 adds up signals processed by the reception delay unit 236 to generate the ultrasound data. A reflection component from a direction determined by the reception directionality may be emphasized by the adding process of the adder 238.

The transmitter 210 and the receiver 230 of the ultrasonic probe 110 may be formed as at least one chip on a substrate. In this regard, the substrate may include silicon (Si), ceramic, or a polymer-based material. In some embodiments, the substrate may include a backing material for absorbing ultrasound waves. Each of the blocks in the transmitter 210 and the receiver 230 may be formed as a chip, or two or more blocks may be formed as a chip. In addition, a chip may be formed to correspond to one transducer 310. Thus, the substrate including at least one of the transmitter 210 and the receiver 230 is referred to as a chip module substrate. The chip module substrate may denote a substrate including some of the chips included in the ultrasonic probe 110, as well as a substrate including all of the chips included in the ultrasonic probe 110.

In addition, the ultrasonic probe 110 may further include some components of the signal processor 120, some components of the display 130, and some components of the user input unit 140, in addition to the transmitter 210 and the receiver 230.

Figure 3:
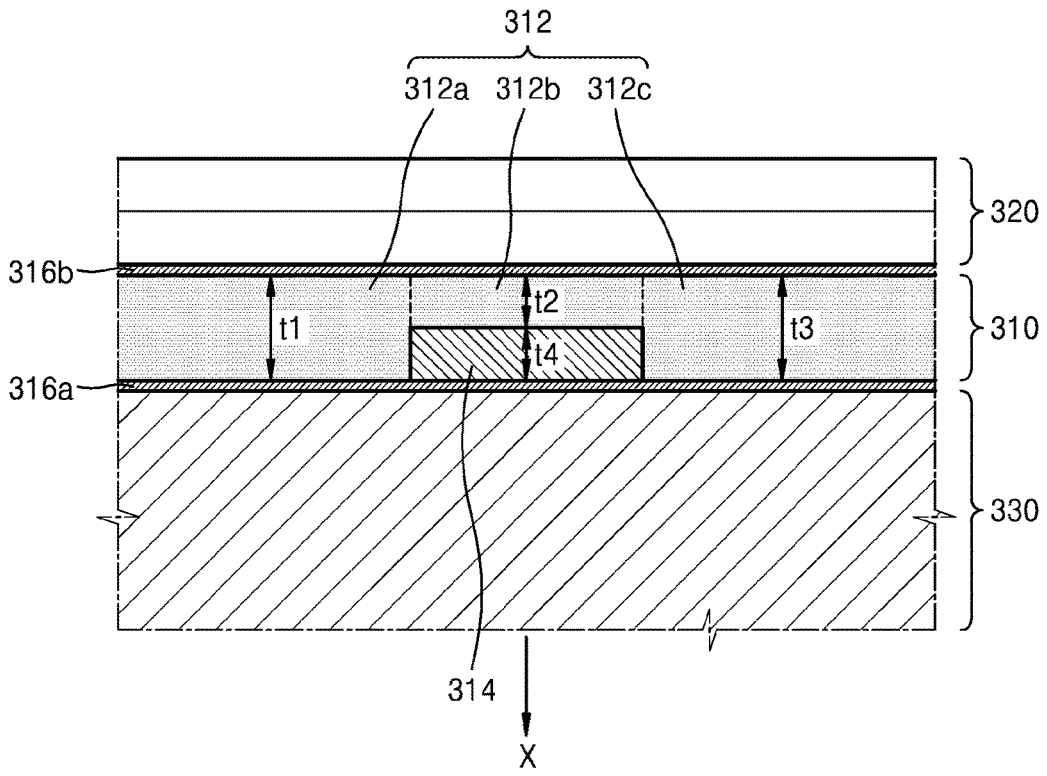
FIG. 3 partially illustrates a physical configuration of the ultrasonic probe illustrated in FIG. 2.
Figure 4:
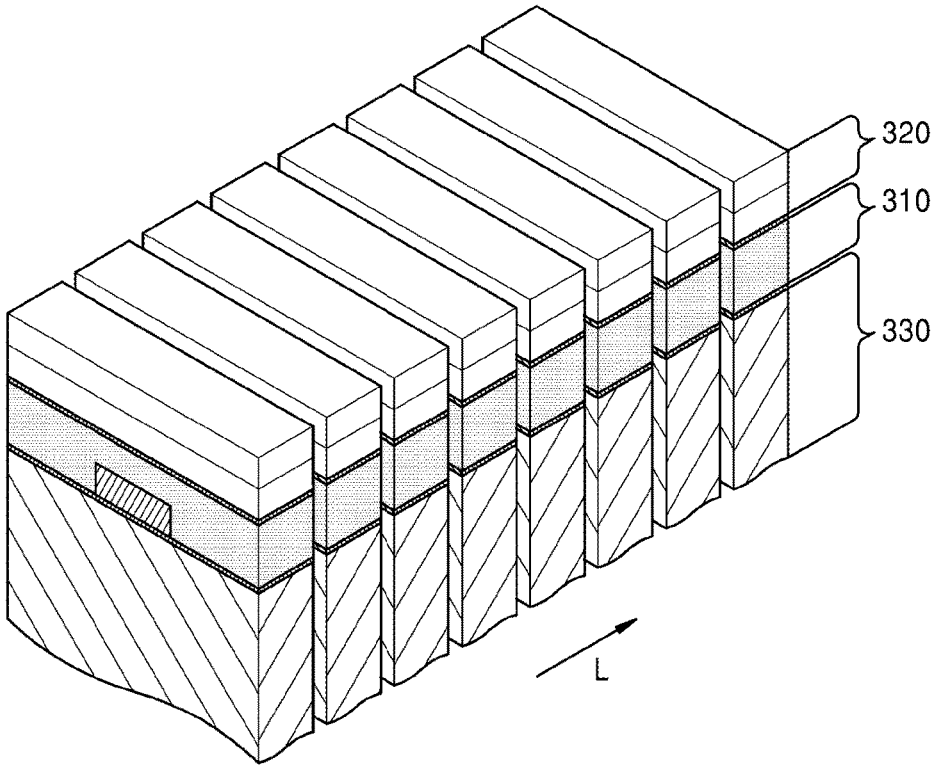
FIG. 4 illustrates an arrangement of transducers according to an embodiment.

FIG. 3 partially illustrates a physical configuration of the ultrasonic probe 110 illustrated in FIG. 2. FIG. 4 illustrates arrangement of the transducers 310 according to an embodiment. As illustrated in FIG. 3, the ultrasonic probe 110 may include a transducer 310 for converting an electric signal and an ultrasound wave into each other, and a matching layer 320 on the transducer 310, the matching layer 320 for matching an acoustic impedance of the ultrasound wave generated from the transducer 310 to an acoustic impedance of an object.

As shown in FIG. 4, the transducers 310 may be arranged one-dimensionally in a length direction L of the transducers 310, and those transducers 310 may be referred to as 1D transducers. The 1D transducers may be a linear array or a curved array. The arrangement of the 1D transducers may be variously set according to intention of the designer. The 1D transducers are manufactured easily, thereby reducing manufacturing costs. However, it is difficult to realize a three-dimensional image by using the 1D transducers.

Although not illustrated, the transducers 310 may be arranged two-dimensionally in the length direction L of the transducers 310 and a direction perpendicular to the length direction L. Those transducers 310 may be referred to as 2D transducers. The 2D transducers may be a linear array or a curved array. The arrangement of the 2D transducers may be variously set according to intention of the designer. In this regard, the 2D transducers appropriately delay input time of signals that are to be respectively input to the transducers 310 and thus transmit the ultrasound waves to the object along an external scan line for transmitting the ultrasound waves. Therefore, a 3D image may be obtained by using a plurality of echo signals. In addition, the more transducers 310, the clearer the ultrasound image.

The transducer 310 includes the piezoelectric layer 312 that converts an electric signal into an ultrasound wave or converts an ultrasound wave (in detail, an echo of the ultrasound wave) into an electric signal, and a dematching layer 314 on a partial region of the piezoelectric layer 312, the dematching layer 314 for reflecting an incident ultrasound wave.

The piezoelectric layer 312 may include a material causing a piezoelectric phenomenon. The material may include at least one of PZT and a single crystal, such as ZnO, AlN, $PbZrTiO_3$ (PZT), $PbLaZrTiO_3$ (PLZT), $BaTiO_3$ (BT), $PbTiO_3$ (PT), $Pb(Mg_{1/3}Nb_{2/3})O_3$—$PbTiO_3$ (PMN-PT), and PIN-PMN-PT. A groove may be in the bottom surface of the piezoelectric layer 312. Also, the dematching layer 314 may be disposed in the groove.

The dematching layer 314 may reflect an ultrasound wave transmitted in a direction opposite to the object. The dematching layer 314 may improve acoustic characteristics of the ultrasound wave. Although the dematching layer 314 does not substantially convert an electric signal and an ultrasound wave into each other, the dematching layer 314 vibrates with the piezoelectric layer 312 and allows the ultrasound wave to be generated from the piezoelectric layer 312. Thus, the dematching layer 314 may be a part of the transducer 310.

An acoustic impedance of the dematching layer 314 may be greater than or the same as an acoustic impedance of the piezoelectric layer 312. For example, the acoustic impedance of the dematching layer 314 may be twice as much as the acoustic impedance of the piezoelectric layer 312 or greater. Thus, the ultrasound wave incident on the dematching layer 314 may be reflected toward the object. The dematching layer 314 may include a material such as tungsten carbide. The dematching layer 314 may be on a partial region of the bottom surface of the piezoelectric layer 312.

The transducer 310 may further include a first electrode **316*a* on a rear surface of the transducer 310 and a second electrode 316*b* on the top surface of the transducer 310. One of the first and second electrodes 316*a* and 316*b* may correspond to a positive electrode (or a signal electrode) of the piezoelectric layer 312, and the other may correspond to a negative electrode (or a ground electrode) of the piezoelectric layer 312. The first and second electrodes 316***a* and 316*b* may be wired by a known means such as the chip module substrate.

By appropriately matching the acoustic impedance of the piezoelectric layer 312 and the acoustic impedance of the object, the matching layer 320 transfers an ultrasound wave to the object or reduces loss of an ultrasound wave transferred from the object. The acoustic impedances of the object and the piezoelectric layer 312 may be matched by adjusting physical parameters such as speed of sound, thickness, and acoustic impedance regarding the matching layer 320. That is, the matching layer 320 controls reflection of the ultrasound wave due to a difference between the acoustic impedance of the object and the acoustic impedance of the piezoelectric layer 312. The matching layer 320 may include a single layer or may have a multi-layered structure.

The ultrasonic probe 110 may further include an acoustic lens (not shown) for focusing the ultrasound wave. The acoustic lens is disposed on the top surface of the piezoelectric layer 312 and focuses the ultrasound wave generated from the piezoelectric layer 312. The acoustic lens may include a material such as silicon rubber having acoustic impedance that is close to that of the object. Also, the center of the acoustic lens may be convex or flat. The acoustic lens may have various shapes according to the design of a designer.

The ultrasonic probe 110 may further include a backing layer 330 that prevents image distortion by absorbing the ultrasound wave travelling to the rear of the piezoelectric layer 312. The backing layer 330 may absorb the ultrasound wave that is transmitted in a direction opposite to the object and is not directly used in a test or diagnosis. The backing layer 330 may support the piezoelectric layer 312 and the dematching layer 314 from below.

Hereinafter, the piezoelectric layer 312 and the dematching layer 314 will be described in detail. A groove is in the bottom surface of the piezoelectric layer 312. Also, the dematching layer 314 may be disposed in the groove. The dematching layer 314 may be symmetric about a central axis X of the ultrasonic probe 110. In this regard, the central axis X of the ultrasonic probe 110 may be parallel to a height direction of the ultrasound wave emitted from the ultrasonic probe 110.

The piezoelectric layer 312 may include a first piezoelectric layer 312*a* that has a first thickness t1 and does not overlap the dematching layer 314, a second piezoelectric layer 312*b* that has a second thickness t2 and overlaps the dematching layer 314, and a third piezoelectric layer 312*c* that has a third thickness t3 and does not overlap the dematching layer 314. Each of the first to third thicknesses t1 to t3 may be uniform. Also, the first thickness t1 and the third thickness t3 may be the same as each other, and the second thickness t2 may be less than the first thickness t1. For example, the first thickness t1 and the third thickness t3 may be multiples of ½ of a wavelength of the ultrasound wave converted in the piezoelectric layer 312. In an embodiment, the first and third thicknesses t1 and t3 may be ½ of the wavelength of the ultrasound wave. In this regard, the wavelength of the ultrasound wave is a wavelength of the ultrasound wave emitted from the ultrasonic probe 110.

A ratio between the first thickness t1 and the second thickness t2 may be a multiple of ¼ of a wavelength of the ultrasound wave. In an embodiment, the ratio between the first thickness t1 and the second thickness t2 may be ¼ of the wavelength of the ultrasound wave. Also, the sum of a thickness t4 of the dematching layer 314 (hereinafter referred to as a 'fourth thickness') and the second thickness t2 may be the same as the first thickness t1. Since the sum of the second thickness t2 and the fourth thickness t4 is the same as the first and third thicknesses t1 and t3, the first to third piezoelectric layers 312*a* to 312*c* may vibrate with respect to the ultrasound wave of the same wavelength.

The first to third piezoelectric layers 312*a* to 312*c* may include the same material as each other. For example, a groove may be formed in a piezoelectric material to form the first to third piezoelectric layers 312*a* to 312*c*. Alternatively, the first to third piezoelectric layers 312*a* to 312*c* may be combined with each other to form one piezoelectric layer 312. Alternatively, at least two of the first to third piezoelectric layers 312*a* to 312*c* may include different materials from each other.

A width of the second piezoelectric layer 312*b* is related to a width, the number of piezoelectric devices, etc. of a neighboring piezoelectric layer, for example, the first piezoelectric layer 312*a* or the third piezoelectric layer 312*c*. For example, a width $W_{312b}$ of the second piezoelectric layer 312*b* may be the same as Equation 1 below.

$$W_{312b} = \frac{t_2}{t_1} * \frac{(N_{312a} + N_{312c})}{N_{312b}} * W_{312a} \quad \text{[Equation 1]}$$

In this regard, t1 denotes a thickness of the first piezoelectric layer 312*a*, t2 denotes a thickness of the second piezoelectric layer 312*b*, $N_{312a}$ denotes the number of first piezoelectric layers 312*a*, $N_{312b}$ denotes the number of second piezoelectric layers 312*b*, $N_{312c}$ denotes the number of third piezoelectric layers 312*c*, and $W_{312a}$ denotes a width of the first piezoelectric layer 312*a*.

As described above, since the dematching layer 314 is disposed at the center of the piezoelectric layer 312, the ultrasound wave incident on the dematching layer 314 is reflected. Thus, intensity of the ultrasound wave incident on the object may reach the maximum at a central axis. This may decrease side lobe and thus improve beam directionality. Further, a length with respect to a focal range may be increased, and an effect of transducers arranged in 1.25 dimension or 1.5 dimension may be expected from one-dimensionally arranged transducers. Also, when the above-described structure is applied to two-dimensionally arranged transducers, apodization may improve.

Figure 5:
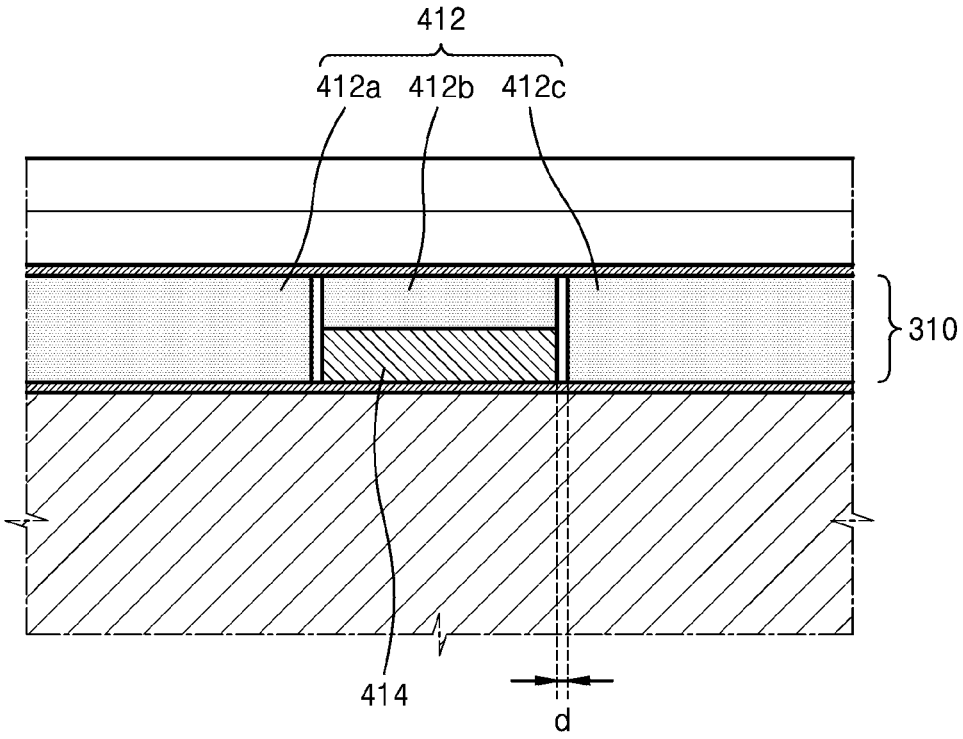
FIG. 5 illustrates an ultrasonic probe according to another embodiment.

FIG. 5 illustrates the ultrasonic probe 110 according to another embodiment. Comparing FIG. 3 and FIG. 5 with each other, at least two of first to third piezoelectric layers 412*a* to 412*c* included in the ultrasonic probe 110 may be separate from each other. Although FIG. 5 illustrates all of the first to third piezoelectric layers 412*a* to 412*c* separate from each other, the present disclosure is not limited thereto. Two of the first to third piezoelectric layers 412*a* to 412*c* may be separate from each other. The separation distance may be less than a wavelength of an ultrasound wave. Although the sum of thicknesses of a dematching layer 414 and the second piezoelectric layer 412*b* is the same as thicknesses of the first piezoelectric layer 412*a* and the third piezoelectric layer 412*c*, material composition of the dematching layer 414 is different from a piezoelectric layer 412, and accordingly, cross talk may occur between ultrasound waves. However, as illustrated in FIG. 5, when the first to third piezoelectric layers 412*a* to 412*c* are separate from each other, occurrence of the cross talk may decrease.

Figure 6:
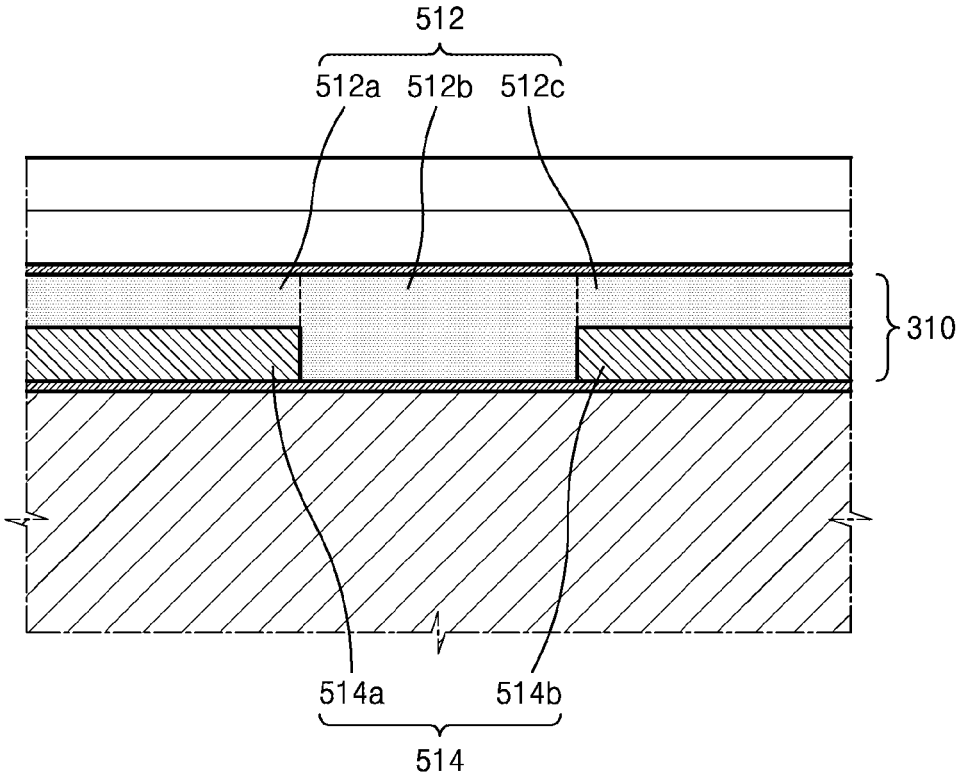
FIGS. 6 to 8 each illustrate an ultrasonic probe according to another embodiment.
Figure 7:
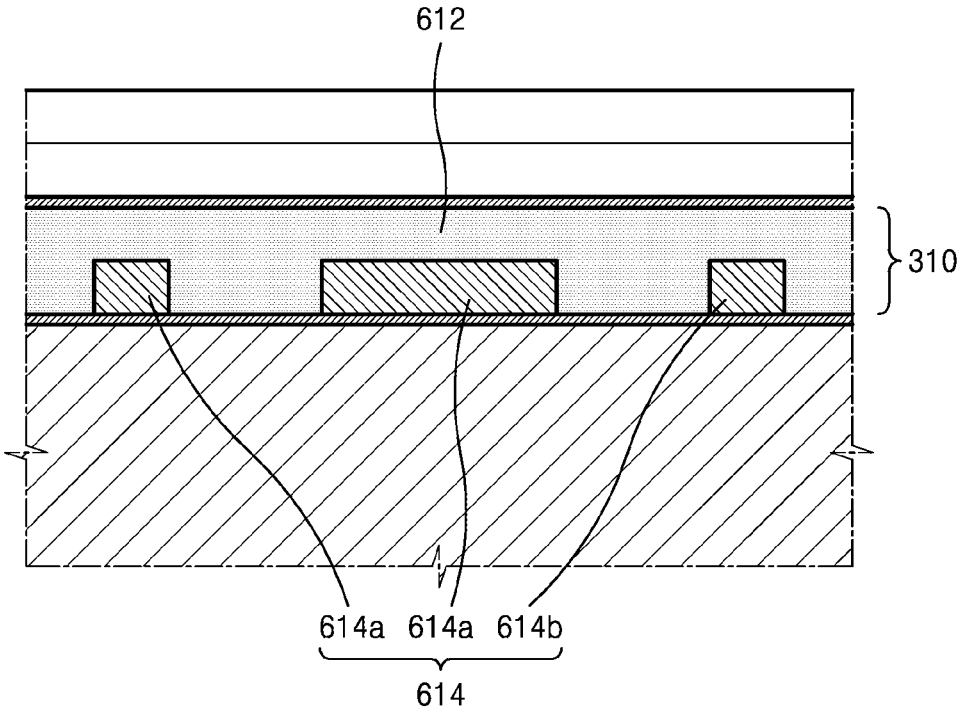
Figure 8:
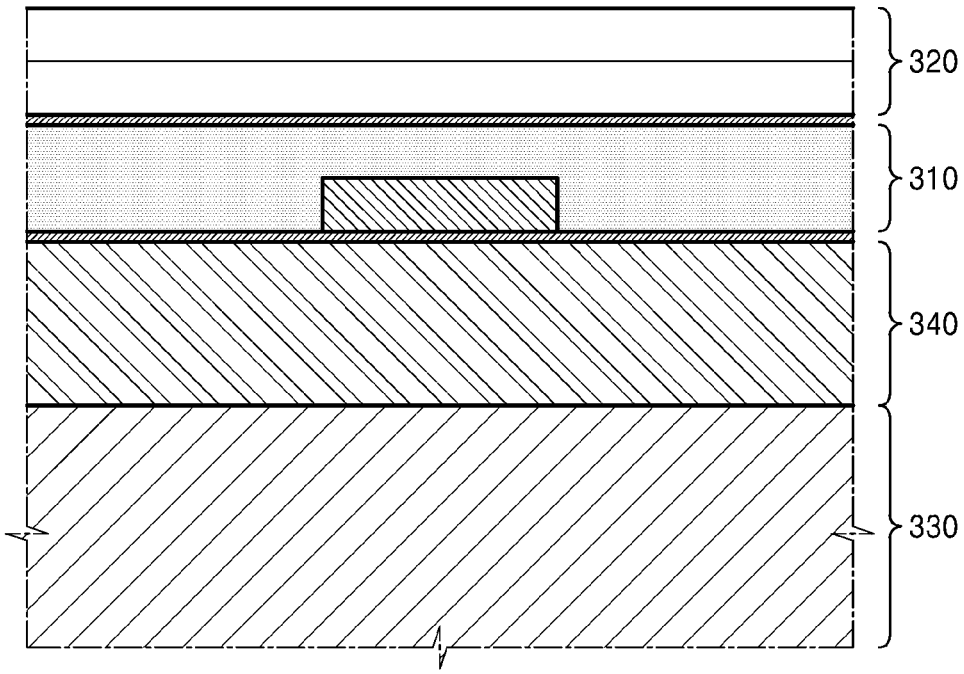

FIGS. 6 to 8 each illustrate an ultrasonic probe according to another embodiment. As illustrated in FIG. 6, a dematching layer 514 may include a plurality of sub dematching layers that are separate from each other. For example, the dematching layer 514 may include a first dematching layer 514*a* and a second dematching layer 514*b* that are separate from each other. The first and second dematching layers 514*a* and 514*b* may be symmetric about a central axis. Also, a partial region of a piezoelectric layer 512 may be between the first and second dematching layers 514*a* and 514*b*. That is, the piezoelectric layer 512 may include a first piezoelectric layer 512*a* that overlaps the first dematching layer 514*a*, a second piezoelectric layer 512*b* that does not overlap the dematching layer 514, and a third piezoelectric layer 512*c* that overlaps the second dematching layer 514*b*. Thicknesses of the first and third piezoelectric layers 512*a* and 512*c* may each be smaller than a thickness of the second piezoelectric layer 512*b*, and the sum of thicknesses of the first piezoelectric layer 512*a* and the first dematching layer 514*a* and the sum of thicknesses of the third piezoelectric layer 512*c* and the second dematching layer 514*b* may each be the same as the thickness of the second piezoelectric layer 512*b*. Intensity of an ultrasound wave emitted from a region in which the dematching layer 514 is disposed may be greater than intensity of an ultrasound wave emitted from a region in which no dematching layer 514 is disposed. Thus, the ultrasonic probe of FIG. 6 may have a multi-focal range.

Alternatively, as illustrated in FIG. 7, the transducer 310 may include first to third dematching layers 614*a* to 614*c* that are separate from each other. The second dematching layer 614*b* may be symmetric about a central axis, and the first and third dematching layers 614*a* and 614*c* may be symmetric around the second dematching layer 614*b*. The ultrasonic probe of FIG. 7 may also have a multi-focal range.

Alternatively, as illustrated in FIG. 8, the transducer 310 of the ultrasonic probe 110 may be connected to a chip module substrate 340, and the backing layer 330 may be disposed under the chip module substrate 340. As described above, the chip module substrate 340 refers to a substrate including at least one chip that processes an electric signal. For example, the chip module substrate 340 may include at least one chip that performs operations of the receiver 230 and the transmitter 210. The chip module substrate 340 may be, but is not limited to, an application specific integrated circuit (ASIC). A position of the backing layer 330 may be different according to factors such as use of an ultrasonic probe. Although FIG. 8 illustrates the backing layer 330 disposed under the chip module substrate 340, the present disclosure is not limited thereto. A substrate of the chip module substrate 340 may include a backing material.

It should be understood that embodiments described herein should be considered in a descriptive sense only and not for purposes of limitation. Descriptions of features or aspects within each embodiment should typically be considered as available for other similar features or aspects in other embodiments.

While one or more embodiments have been described with reference to the figures, it will be understood by those of ordinary skill in the art that various changes in form and details may be made therein without departing from the spirit and scope of the inventive concept as defined by the following claims.

What is claimed is:

1. An ultrasonic transducer comprising:

a piezoelectric layer configured to convert an electric signal and an ultrasound into each other; and a dematching layer having a uniform thickness, the dematching layer being arranged on a partial region of the piezoelectric layer and configured to reflect the second ultrasound wave that is incident on the dematching layer, wherein the piezoelectric layer comprises:

a first piezoelectric layer that has a first thickness and does not overlap the dematching layer; and a second piezoelectric layer that has a second thickness and overlaps the dematching layer.

2. The ultrasonic transducer of claim 1, wherein the piezoelectric layer comprises a groove.

3. The ultrasonic transducer of claim 2, wherein the dematching layer is arranged in the groove.

4. The ultrasonic transducer of claim 1, wherein the dematching layer is symmetric about a central axis of the ultrasonic transducer.

5. The ultrasonic transducer of claim 1, wherein the first and second thicknesses are uniform.

6. The ultrasonic transducer of claim 1, wherein the first thickness is greater than the second thickness.

7. The ultrasonic transducer of claim 1, wherein a sum of a thickness of the dematching layer and a thickness of the second piezoelectric layer is equal to or less than a thickness of the first piezoelectric layer.

8. The ultrasonic transducer of claim 1, wherein a ratio between the first thickness and the second thickness is equal to or greater than a multiple of ¼ of a wavelength of the ultrasound wave.

9. The ultrasonic transducer of claim 1, wherein the first thickness is a multiple of ½ of a wavelength of the ultrasound wave.

10. The ultrasonic transducer of claim 1, wherein the first piezoelectric layer and the second piezoelectric layer comprise a same material.

11. The ultrasonic transducer of claim 1, wherein the first piezoelectric layer contacts the second piezoelectric layer.

12. The ultrasonic transducer of claim 1, wherein the first piezoelectric layer is spaced apart from the second piezoelectric layer.

13. The ultrasonic transducer of claim 12, wherein the first piezoelectric layer is spaced apart from the second piezoelectric layer by a distance that is less than a wavelength of the ultrasound wave.

14. The ultrasonic transducer of claim 1, further comprising a third piezoelectric layer that has a third thickness and does not overlap the dematching layer.

15. The ultrasonic transducer of claim 14, wherein the third thickness is the same as the first thickness.

16. The ultrasonic transducer of claim 1, further comprising an electrode that contacts the piezoelectric layer and the dematching layer.

17. The ultrasonic transducer of claim 1, wherein the dematching layer comprises a plurality of sub dematching layers that are spaced apart from each other.

18. The ultrasonic transducer of claim 17, wherein the partial region of the piezoelectric layer is arranged between the plurality of sub dematching layers.

19. An ultrasonic probe comprising:

the ultrasonic transducer of claim 1; and a matching layer that is disposed on the ultrasonic transducer and matches an acoustic impedance of the ultrasound wave and an acoustic impedance of an object.

* * * * *